United States Patent [19]

Forster et al.

[11] 4,286,055

[45] Aug. 25, 1981

[54] PROCESS FOR THE PREPARATION OF MONODISPERSE PHOTOGRAPHIC SILVER HALIDE EMULSIONS OF IMPROVED SENSITIVITY

[75] Inventors: Ralf-Udo P. Forster; Rolf H. F. Metzger, both of Dreieich, Fed. Rep. of Germany

[73] Assignee: E. I. Du Pont de Nemours and Company, Wilmington, Del.

[21] Appl. No.: 126,295

[22] Filed: Mar. 3, 1980

[30] Foreign Application Priority Data

Aug. 11, 1979 [DE] Fed. Rep. of Germany ..... 2932650

[51] Int. Cl.[3] ..... G03C 1/02

[52] U.S. Cl. ..... 430/567; 430/569; 430/603

[58] Field of Search ..... 430/567, 569, 603

[56] References Cited

U.S. PATENT DOCUMENTS

| | | | |
|---|---|---|---|
| 2,592,250 | 6/1952 | Davey et al. | 430/567 |
| 3,622,318 | 11/1971 | Evans | 430/507 |
| 3,767,413 | 10/1973 | Miller | 430/569 |
| 4,078,937 | 3/1978 | Tani et al. | 430/569 |
| 4,165,986 | 8/1979 | Walworth | 430/567 |
| 4,210,450 | 7/1980 | Corben | 430/569 |

FOREIGN PATENT DOCUMENTS

| | | |
|---|---|---|
| 2042188 | 3/1971 | Fed. Rep. of Germany . |
| 2141392 | 2/1972 | Fed. Rep. of Germany . |
| 2344331 | 9/1976 | Fed. Rep. of Germany . |
| 1027146 | 4/1966 | United Kingdom . |

*Primary Examiner*—J. Travis Brown

[57] ABSTRACT

The speed of monodisperse photographic emulsions made by balanced doubled jet precipitation and converted into a AgBr and/or AgBrI emulsion is increased by ripening in the presence of sulfur compounds at a pH between 8 and 9.5.

6 Claims, No Drawings

PROCESS FOR THE PREPARATION OF MONODISPERSE PHOTOGRAPHIC SILVER HALIDE EMULSIONS OF IMPROVED SENSITIVITY

BACKGROUND OF THE INVENTION

The invention relates to improvement of sensitivity of sulfur-sensitized light-sensitive monodisperse silver halide emulsions.

As a rule, monodisperse silver halide emulsions are prepared by a pAg-controlled twin jet method in which silver nitrate and an alkali metal halide solution are simultaneously added to a gelatin solution while maintaining a constant silver ion concentration. Thus German Pat. No. 1,169,290 discloses a process of producing photographic silver halide emulsions with an extremely narrow grain size distribution. According to a preferred embodiment, successive precipitation reactions are used, so that core-shell structures are formed. German Pat. No. 2,344,331 discloses a process for the preparation of lith emulsions which, likewise, have a core-shell structure and a narrow grain size distribution.

Monodisperse silver halide emulsions excel, by a higher covering power, over emulsions with the same average grain diameter but wider grain size distribution. Because of this, there is considerable interest in this type of emulsion. The disadvantage of monodisperse emulsions is that, as a result of their very perfect crystalline structure, they cannot be sufficiently chemically sensitized. As a result their area of application is greatly limited. Considerable effort has been made to raise the sensitivity of these emulsions, but most of the known processes are so complicated that they are unsuitable for industrial use. German Preliminary Published Application No. 2,042,188 discloses a process which makes it possible to raise sensitivity slightly, but it is still disadvantageous because after a brief period of storage a strong fogging occurs.

It is, moreover, known that silver halide emulsions with narrow grain size distribution and thus a high covering power can also be produced according to the conversion method wherein silver halide emulsions are converted to mixed silver halide emulsions, so-called converted emulsions, by reaction with selected alkali metal halides. Converted silver halide emulsions are disclosed in e.g., U.S. Pat. No. 2,592,250. Such emulsions have a high internal image sensitivity and must be developed using special internal image developers, because there would be no image reproduction using conventional surface developers. Because the inner image always competes with the surface image, there are considerable difficulties in sufficiently elevating the surface sensitivity of these emulsions. This state of affairs is disclosed in German Preliminary Published Application No. 2,141,392, page 2, middle paragraph. It can be inferred from the examples of said Published Application that in spite of using a very complicated chemical sensitization, surface sensitivity cannot be raised sufficiently to effect image reproduction with a surface developer.

Therefore, the problem underlying the present invention is to provide a commercial process for improving the sensitivity of sulfur-sensitized monodisperse emulsions.

SUMMARY OF THE INVENTION

This problem is solved by the present invention wherein a monodisperse silver chloride or silver chloride-bromide emulsion is prepared according to conventional processes and, subsequently, is converted into a silver bromide- and/or silver bromide-iodide emulsion, characterized in that the converted emulsion is chemically ripened in the presence of a sulfur sensitizer at a pH value between 8 and 9.5. This process makes it possible to prepare, on an industrial scale, monodisperse emulsions which excel by a considerably improved sensitivity without simultaneous increase in fogging. The good sensitivity/fogging ratio is maintained even after a long time of storage.

DETAILED DISCLOSURE OF THE INVENTION

To carry out the process, a monodisperse silver chloride- or silver chloride-bromide emulsion is first precipitated in known manner, at pAg values between 4.5 and 8.5. In case of mixed chloride emulsions the bromide portion, however, should not amount to more than 80 mol %.

As a conversion solution, there is added to the emulsion a heated aqueous solution of a bromide, heated to 35°–85° C. for conversion. Soluble bromides suitable for conversion are, e.g., sodium bromide, potassium, and ammonium bromode. The amount of added bromide can be equimolar in reference to the chloride content of the monodisperse silver halide emulsion; however, it can also be used in a molar excess up to 50%. If desired, the conversion solution may also contain a soluble iodide sufficient to yield an iodide content of up to 5 mol % of the converted emulsion.

In a preferred embodiment, the conversion can also be carried out in such a way that the monodisperse silver halide emulsion is added to an existing aqueous bromide- and/or bromide-iodide solution. In this way monodisperse emulsions with an optimal sensitivity/-fogging ratio are obtained.

In another embodiment the monodisperse silver halide emulsion first precipitated is simultaneously transferred with the conversion solution to a suitable container vessel wherein, after conversion, the converted emulsion is digested, chilled, flocculated, and washed in conventional manner. After washing, the emulsion is redispersed with gelatin, and conventional ripening agents are added; in accordance with the invention at least one sulfur sensitizer must be used. Subsequently, it (the emulsion) is chemically ripened at a pH value between 8 and 9.5.

Suitable sulfur sensitizers are well-known and are described, e.g., in U.S. Pat. No. 1,574,944 "Photographic Light-Sensitive Material and Process of Making the Same" (1926). They include allyl isothiocyanate, allyl thiourea, thiosulfates, sodium, potassium, and ammonium thiosulfate, organic sulfides and disulfides, and the like. In addition to the sulfur sensitizers, emulsions may contain conventional noble metal salts, preferably gold salts. Moreover, other known sensitizers may be added to the emulsion, if necessary, e.g., optical sensitizers; also agents to increase covering power, wetting agents, antistatic additives, hardeners, and the like may be present.

Monodisperse emulsions obtained according to the process of the invention excel over the known emulsions of this type by exhibiting a considerably improved sensitivity/fogging ratio, one which remains constant even during lengthy periods of storage. Depending on the selected precipitation conditions particle sizes up to 2.5 $\mu m^3$ are attainable.

This result is surprising from two points of view. For one, it was not expected by those skilled in the art that the surface sensitivity of a conversion emulsion, known to be difficult or impossible to chemically sensitize, can be increased so much in a simple manner. Secondly, it is known to those skilled in the art that chemical ripening must be carried out in a weak acid environment at pH values between 6 and 7, because otherwise considerable sensitivity losses will occur and emulsions will lose their storability. It is, therefore, completely surprising that the sensitivity of an emulsion can be raised by ripening in an alkali environment at pH values between 8 and 9.5 without simultaneously encountering undesirable fogging and losses in sensitivity on storage.

Emulsions obtained according to the present invention can be advantageously used for a number of applications, e.g., the manufacture of X-ray films, photographic or copying material, etc. The following examples serve to illustrate the invention:

EXAMPLE 1

While maintaining a pAg value of 5.0 and proceeding according to the twin jet precipitation method, 1,000 ml of a 3 molar $AgNO_3$ solution and 1,000 ml of a 3 molar KCl solution were added to 500 ml of a 10% by weight gelatin solution heated to 65° C. The resulting solution was then heated to 70° C. and was converted by the addition of 1,500 ml of a 3 molar potassium bromide solution likewise heated to 70° C. After cooling, the emulsion was flocculated, freed of soluble salts by washing, and redispersed. The emulsion then was divided into two parts, A and B; the pH value of sample A was adjusted to 6.5 and the pH value of sample B to 8.5 Both samples then were afterripened in known manner employing sodium thiosulfate as the sulfur sensitizer (21 μmol/mol Ag), then were provided with conventional casting additives, and were cast so as to form a dry coating of 6 g silver/$m^2$.

One sample each of both film materials was exposed in the form of test strips in a sensitometer. The exposure time was 0.2 s. Subsequently, each sample was developed for 3 min at 20° C. in a developer of the following composition:

Hydroquinone: 31.00 g
1-phenyl-3pyrazolidone: 0.83 g
$K_2S_2O_5$: 58.00 g
$NaBO_2.4H_2O$: 26.30 g
KOH 55.60 g:
Water sufficient to make 1 liter.

After fixing and drying, evaluation yielded the values summarized in Table 1 wherein the relative sensitivity of the comparative emulsion = 100, and the other samples were evaluated in relation to this. Sensitivity was evaluated at a density of 1.0 above fog.

TABLE 1

| Sample | Relative Sensitivity | Fog |
|---|---|---|
| A | 100 | 0.12 |
| B | 220 | 0.14 |

EXAMPLE 2

A monodisperse emulsion was precipitated and converted according to the process of EXAMPLE 1. The emulsion was then flocculated in conventional manner, washed free of soluble salts, redispersed, and divided into two parts, A and B, the pH value of sample A was adjusted to 6.5, and the pH value of sample B to 8.2. Both emulsions were then afterripened in the presence of bis-(dimethylamino-thiocarbonyl)-sulfide as the sulfur sensitizer, were cast according to the data of EXAMPLE 1, and were developed and evaluated. The results are summarized in Table 2.

TABLE 2

| Sample | Relative Sensitivity | Fog |
|---|---|---|
| A | 80 | 0.20 |
| B | 150 | 0.24 |

A monodisperse emulsion was precipitated and converted as in Example 1, flocculated in conventional manner, freed of soluble salts by washing, and redispersed. The emulsion was then divided into two parts, A and B. The pH value of sample A was adjusted to 6.5 and the pH value of sample B to 9.0. Both emulsions were then afterripened in known manner in the presence of allyl isothiocyanate as the sulfur sensitizer, were cast according to the data of Example 1, and were developed and evaluated. The results are summarized in Table 3.

TABLE 3

| Sample | Relative Sensitivity | Fog |
|---|---|---|
| A | 100 | 0.12 |
| B | 200 | 0.20 |

EXAMPLE 4

Sample

While maintaining a pAg value of 7.8 and proceeding by the twin jet precipitation method, 1,000 ml of a 3 molar $AgNO_3$ solution and 1,000 ml of a 3 molar solution of 80 mol % KBr/20 mol % KCl were added to 1,000 ml of a 5 wt. % ammoniacal gelatin solution heated to 50° C. The resulting solution was heated 80° C. and was then converted by the addition of 400 ml of a 3 molar KBr solution likewise heated to 80° C.

Sample B

While maintaining a pAg value of 7.8 and proceeding by the twin jet precipitation method, 1,000 ml of a 3 molar $AgNO_3$ solution and 1,000 ml of a 3 molar KCl solution were added to 1,000 ml of a 5% gelatin solution heated to 50° C. The resulting solution was heated to 80° C. and was then converted by the addition of 1,200 ml of a 4 molar KBr solution likewise heated to 80° C.

Sample C

A monodisperse silver bromide emulsion was prepared as follows as a control:

While maintaining a pAg value of 7.8 and proceeding by the twin jet precipitation method, 1,000 ml of a 3 molar $AgNO_3$ solution and 1,000 ml of a 3 molar KBr solution were added to 1,000 ml of a 5% ammoniacal gelatin solution heated to 50° C. After cooling all three emulsions, the latter were flocculated, freed of soluble salts by washing, and redispersed. Samples of each emulsion, with pH values of 6.5 and 8.5, were then afterripened in the presence of sodium thiosulfate as the sulfur sensitizer as in Example 1 and were further processed. The results are summarized in Table 4.

TABLE 4

| Sample | Relative Sensitivity | Fog pH 6.5 | Relative Sensitivity | Fog pH 8.5 |
|---|---|---|---|---|
| A | 100 | 0.12 | 220 | 0.15 |
| B | 100 | 0.13 | 210 | 0.14 |
| C | 125 | 0.21 | 110 | 0.20 |

EXAMPLE 5

While maintaining a pAg value of 5.0 and proceeding by the twin jet precipitation method, 1,000 ml of a 3 molar $AgNO_3$ solution and 1,000 ml of a 3 molar KCl solution were added to 500 ml of a 10 wt. % gelatin solution heated to 65° C. The solution then was heated to 70° C. and was converted by the addition of 1,500 ml of a 3 molar KBr solution likewise heated to 70° C. After cooling the emulsion, the latter was flocculated, freed of soluble salts by washing, and redispersed. The emulsion then was divided into two parts, A and B, and the pH value of sample A was adjusted to 6.5 and the pH value of sample B to 8.5. Both emulsions then were afterripened as in Example 1 in the presence of sodium thiosulfate as the sulfur sensitizer.

As the control, a monodisperse silver bromide emulsion was prepared according to Example 1 of German Preliminary Published Application No. 2,042,188 After washing and redispersion the emulsion was divided into two parts, C and D. Part C was chemically sensitized as in Example 1 of said Published Application No. 2,042,188 and adjusted to a pH value of 6.5. Sample D was chemically sensitized in the same way, except that the pH value was 8.5.

All four samples then were cast and further processes as in Example 1 of the present application. The results are summarized in Table 5.

TABLE 5

| Sample | 1 week Relative Sensitivity | Fog | 4 weeks Relative Sensitivity | Fog | 3 weeks Relative Sensitivity | Fog |
|---|---|---|---|---|---|---|
| A | 100 | 0.12 | 100 | 0.13 | 90 | 0.13 |
| B | 220 | 0.12 | 220 | 0.12 | 210 | 0.13 |
| C | 110 | 0.19 | 110 | 0.30 | 100 | 0.39 |
| D | 120 | 0.20 | 110 | 0.30 | 100 | 0.41 |

It is evident from the table, that if one were to proceed according to the process of German Preliminary Published Application No. 2,042,188 the sensitivity values of the present application could not be achieved, not even when chemical sensitization was carried out at pH values >8. Additionally, it is evident that light-sensitive materials produced according to the data of said Published Application No. 2,042,188, did not have a sufficient storability.

EXAMPLE 6

While maintaining a pAg value of 8.0 and proceeding by the twin jet precipitation method, 1,000 ml of a 3 molar $AgNo_3$ solution and 1,000 ml of a 3 molar KCl solution were added to 500 ml of a 5 wt. % gelatin solution heated to 55° C. For conversion, 1,250 ml of this emulsion heated at 65° C. were added to 750 ml of a 3 molar KBr solution having the same temperature and containing sufficient KI that the iodine portion of the converted emulsion was 1.6 mol %.

After cooling the emulsion it was flocculated, freed of soluble salts by washing, and redispersed. The emulsion was then divided into two parts, A and B; the pH value of sample A was adjusted to 6.5 and the pH value of sample B to 9.2.

Both samples were afterripened by the process of Example 1 in the presence of sodium thiosulfate as the sulfur sensitizer and were further processed. The results obtained after evaluation are summarized in Table 6.

TABLE 6

| Sample | Relative Sensitivity | Fog |
|---|---|---|
| A | 110 | 0.16 |
| B | 240 | 0.12 |

EXAMPLE 7

While maintaining a pAg value of 6.0 and proceeding by the twin jet precipitation method, 1,000 ml of a 3 molar $AgNO_3$ solution and 1,000 ml of a 3 molar KCl solution were added to 500 ml of a 5 wt. % gelatin solution heated to 35° C. For conversion, 2,500 ml of the emulsion heated to 55° C. and 2,500 ml of a 1.5 molar KBr solution of the same temperature were simultaneously transferred to a container vessel. After cooling the emulsion it was flocculated, freed of soluble salts by washing, and redispersed. The emulsion then was divided into two parts, A and B; the pH value of sample A was adjusted to 6.5 and the pH value of sample B to 9.0. Both samples then were afterripened as in Example 1 in the presence of sodium thiosulfate as the sulfur sensitizer and were further processed. The results obtained after evaluation are summarized in Table 7.

TABLE 7

| Sample | Relative Sensitivity | Fog |
|---|---|---|
| A | 60 | 0.10 |
| B | 130 | 0.11 |

We claim:

1. A process for the preparation of a mondisperse silver halide emulsion of improved sensitivity, by the steps of (a) precipitating a monodisperse silver chloride or silver chloride-bromide emulsion, (b) converting this emulsion to a silver bromide or silver bromide-iodide emulsion by mixing it with a conversion solution of a bromide or a bromide-iodide mixture at elevated temperature, and (c) chemically ripening the converted emulsion, characterized in that the chemical ripening is carried out in the presence of a sulfur sensitizer at a pH value between 8 and 9.5.

2. The process of claim 1 wherein the monodisperse silver chloride-bromide emulsion contains no more than 80 mol % bromide.

3. The process of claims 1 or 2 wherein, for conversion, the monodisperse silver chloride and/or silver chloride-bromide emulsion is added to the conversion solution.

4. The process of claim 1, 2, or 3 wherein the conversion solution contains a soluble iodide in such quantities that the iodide content of the converted emulsion is up to 5 mol %.

5. The process of claim 1, 2, 3, or 4 wherein, for conversion, the monodisperse silver chloride and/or silver chloride-bromide emulsion and the conversion solution are simultaneously transferred to a container vessel.

6. The process of claim 1, 2, 3, 4, or 5 wherein the sulfur sensitizer is sodium thiosulfate.

* * * * *